US005562044A

United States Patent [19]

Wiebe

[11] Patent Number: 5,562,044

[45] Date of Patent: Oct. 8, 1996

[54] STEERING RAILWAY TRUCK

[75] Inventor: Donald Wiebe, Sewickley, Pa.

[73] Assignee: Hansen Inc., Pittsburgh, Pa.

[21] Appl. No.: 452,678

[22] Filed: May 30, 1995

[51] Int. Cl.[6] ..... B61D 15/00; B61F 5/26

[52] U.S. Cl. ..... 105/168; 105/220; 105/222

[58] Field of Search ..... 105/165, 167, 105/168, 182.1, 218.1, 218.2, 220, 222, 224.1

[56] References Cited

U.S. PATENT DOCUMENTS

| | | | |
|---|---|---|---|
| 1,744,986 | 1/1930 | Richards | 105/168 X |
| 2,031,777 | 2/1936 | Johnson | 105/220 X |
| 2,207,848 | 7/1940 | Barrows | 105/224.1 |
| 2,756,688 | 7/1956 | Furrer | 105/4 |
| 2,792,791 | 5/1957 | Kreissig | 105/416 |
| 2,908,233 | 10/1959 | Furrer | 105/453 |
| 2,956,515 | 10/1960 | Lich | 105/4 |
| 3,254,610 | 6/1966 | Roley | 105/179 |
| 3,517,620 | 6/1970 | Weber | 105/167 |
| 3,528,374 | 9/1970 | Duffield | 105/182 |
| 3,948,188 | 4/1976 | Zehnder | 105/167 |
| 3,965,825 | 6/1976 | Sherrick | 105/222 X |
| 4,064,809 | 12/1977 | Mulcany | 105/167 |
| 4,134,343 | 1/1979 | Jackson | 105/167 |
| 4,135,456 | 1/1979 | Welsh | 105/168 X |
| 4,136,620 | 1/1979 | Scheffel et al. | 105/168 |
| 4,151,801 | 5/1979 | Schefflel et al. | 105/168 |
| 4,166,611 | 9/1979 | Geers et al. | 267/3 |
| 4,170,179 | 10/1979 | Vogel | 105/168 |
| 4,173,933 | 11/1979 | Bogie | 105/182 R |
| 4,202,276 | 5/1980 | Browne et al. | 105/165 |
| 4,300,454 | 11/1981 | Scheffel | 105/168 |
| 4,480,553 | 11/1984 | Scheffel | 105/167 |
| 4,512,261 | 4/1985 | Horger | 105/167 |
| 4,802,418 | 2/1989 | Okamoto et al. | 105/168 X |
| 5,009,521 | 4/1991 | Wiebe | 384/191.1 |

FOREIGN PATENT DOCUMENTS

| | | | |
|---|---|---|---|
| 27166 | 4/1981 | European Pat. Off. | 105/221.1 |
| 1068314 | 1/1984 | U.S.S.R. | 105/168 |

OTHER PUBLICATIONS

Report 5576–78 — Canadian Pacific LTD Dept of Research, Nov. 1978.

*Primary Examiner*—Robert J. Oberleitner
*Assistant Examiner*—Kevin D. Rutherford
*Attorney, Agent, or Firm*—J. Stewart Brams

[57] ABSTRACT

A railway vehicle truck having side frames which are supported with respect to the journals of spaced apart wheelsets with the respective pair of wheelset axle ends supporting each side frame being constrained to move simultaneously in opposite directions toward and away from each other in response to truck steering impulses.

10 Claims, 7 Drawing Sheets

STEERING RAILWAY TRUCK

BACKGROUND OF THE INVENTION

Conventional roller bearing three-piece trucks have been standard railway industry equipment, especially in freight service, for many years. Such recent developments as higher center of gravity cars, heavier load limits and higher car operating speeds have resulted in significantly increased average and peak axle loads which are of particular significance as regards truck tracking performance. For example, in instances where a conventional three-piece truck is traveling on curved track, the conical wheels may not track around the curve but rather may have a tendency to slide on the rail head with severe flange rubbing. Such sliding, especially with large axle loads, can result in undue wear of the truck wheels and track components, and lateral track misalignment among other adverse consequences.

The art describes a variety of truck arrangements, often referred to as steering trucks, which are intended to permit the truck wheelsets to track without experiencing sliding or undue flange rubbing in curves. For example, Report No. 5576-78, issued in November, 1978 by the Department of Research—Canadian Pacific Limited, describes several such trucks.

Examples of other art which may be germane to steering truck arrangements are U.S. Pat. Nos. 4,202,276; 4,173,933; 4,170,179; 4,166,611; 4,151,801; 4,136,620; 2,134,343; 4,064,069; 3,948,188; 3,528,374; 3,517,620; 3,254,610; 2,956,515; 2,908,233; 2,756,688; 2,722,791; and 2,207,848.

Some prior steering truck arrangements attempt to isolate the side frames from the wheelset axle bearings in a manner to permit limited wheelset freedom and provide controlled restraint of the resulting wheelset excursions to thereby permit the wheelsets to yaw independently and track around curves without sliding and flange rubbing. However, permitting such independent wheelset yaw freedom for truck steering can also increase the tendency toward truck hunting.

Hunting in railway vehicles is the unstable cyclic yawing of trucks, and the resultant lateral oscillation of the railway car when the truck and car body oscillations become dynamically coupled. The hunting phenomenon is of particular significance in empty cars traveling at relatively high speeds, for example in excess of 40 miles per hour. Lateral track irregularities and the generally sinusoidal truck movement produced by conventional coned wheel geometry results in lateral wheelset excursions as each side of the wheelset alternately moves ahead of the other. This in turn can cause the wheel flanges to impact and rub against first one rail and then the other. These lateral impact loads can cause undesirable lateral car body oscillations and excessive truck component and rail wear. As the wheel treads and flanges wear, the wheel tread conicity becomes more severe and the flange-to-rail clearance increases thereby permitting even larger lateral excursions of the wheelsets during hunting and more severe dynamic response at lower speeds. In the extreme, lateral excursions can become severe enough to precipitate truck derailment.

Various improvements intended to control or eliminate such hunting responses have been developed. See for example my U.S. Pat. Nos. 4,080,016, 4,915,031 and Re. 31,784.

Such art as mentioned immediately above discloses devices which act at the side bearing locations to inhibit car body motions by directly restraining relative motion between the car body and the truck.

The prior art relating to steering trucks does in some instances address the matter of hunting problems which are aggravated by freeing the wheelset axle for movement with respect to the truck side frames. For example, U.S. Pat. No. 4,512,261 discloses an arrangement which reduces the lateral wheelset-to-side frame restraint, thus in turn reducing the wheelset-to-car body restraint. The side frame-to-wheelset freedom in this last mentioned patent affords sufficient longitudinal freedom for steering and reduced car body coupling by virtue of the lateral wheelset freedom.

The problem of hunting due to wheelset yaw has also been addressed in the prior art by truck arrangements providing articulating structures such as linkage arrangements which connect the wheelsets to force the linked wheelsets to move with respect to each other in predetermined ways. See for example U.S. Pat. Nos. 4,136,620, 4,067,262, 4,067,261 and 4,151,801.

The art has not been entirely successful in providing both steering and hunting control for railway trucks owing to the variety and complexity of the causes of these phenomena, including excessive component wear and/or maintenance problems, and exposure of link elements (in the case of wheelset articulation devices) to adverse operating conditions.

BRIEF SUMMARY OF THE INVENTION

The present invention contemplates a railway truck and steering apparatus therefor which may include a rigid tie bar or link extending longitudinally of a side frame and connected at spaced locations to a steering suspension by which the truck side frames are at least partially supported with respect to the wheelsets. The wheelset articulation offered by the present invention constrains each pair of wheelset axle ends supporting a side frame to move toward and away from each other simultaneously in equal and opposite increments of motion, with respect to the side frames. The wheelsets thus being free to steer, can run parallel on tangent track and in a radial configuration on curved track. The above-mentioned steering suspension may include suspension links, resilient elastomeric bearing pads, or combinations of these and other suspension components.

One object of this invention therefore is to provide a steering system and railway truck including the same having a mechanical coupling arrangement which connects the wheelset axles to control hunting due to cyclic wheelset yaw.

Another object of the invention is to provide a steering truck and system which permits the wheelsets to run parallel to each other on tangent track and in a radial configuration symmetrical with the truck on curved track.

The manner in which this invention fulfills these and other objects and advantages of the invention will be more fully understood upon consideration of the following detailed description and the accompanying drawings, in which.

Figure 1:
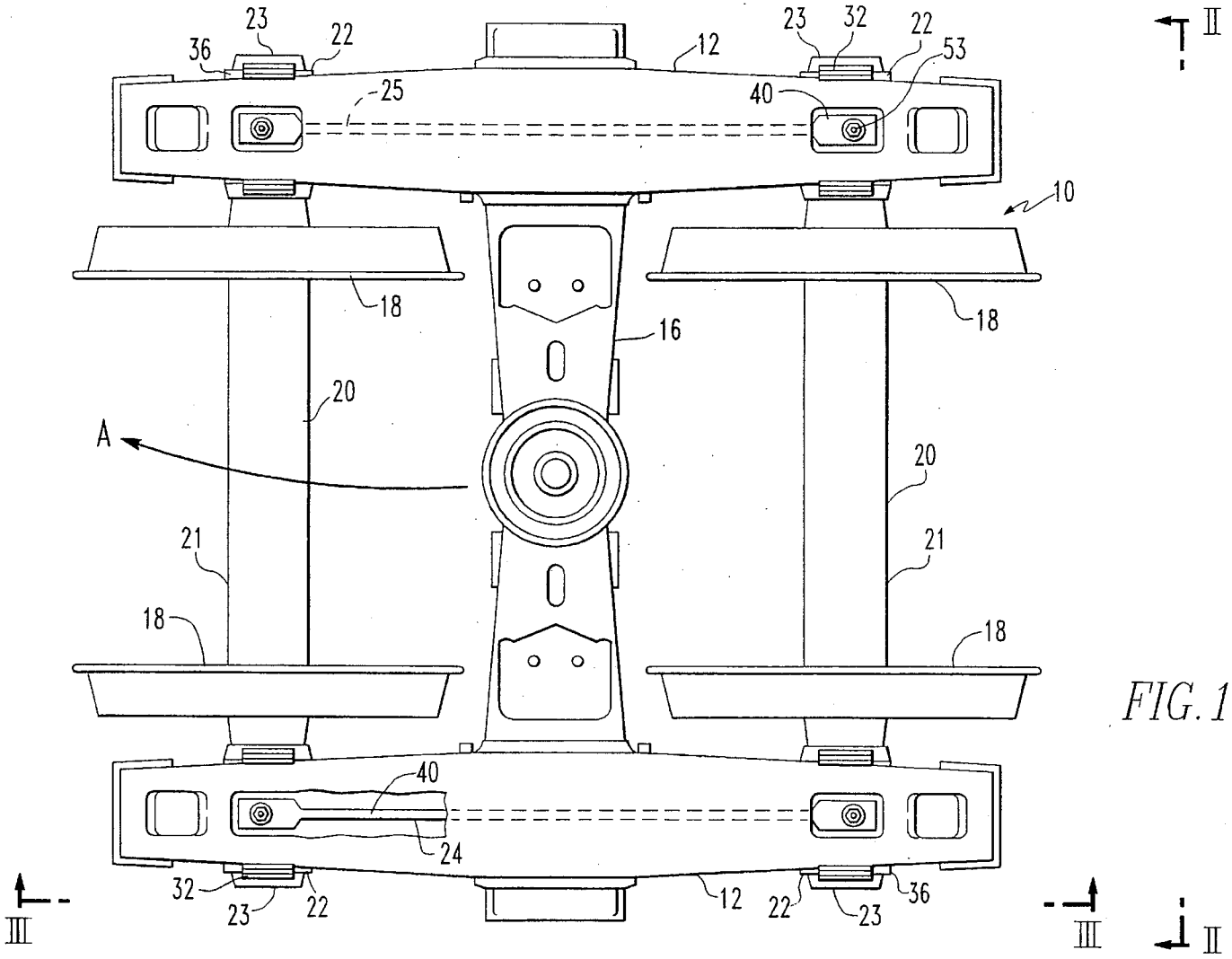
FIG. 1 is a plan view of a three-piece railway truck and steering apparatus according to an illustrative embodiment of the present invention.
Figure 2:
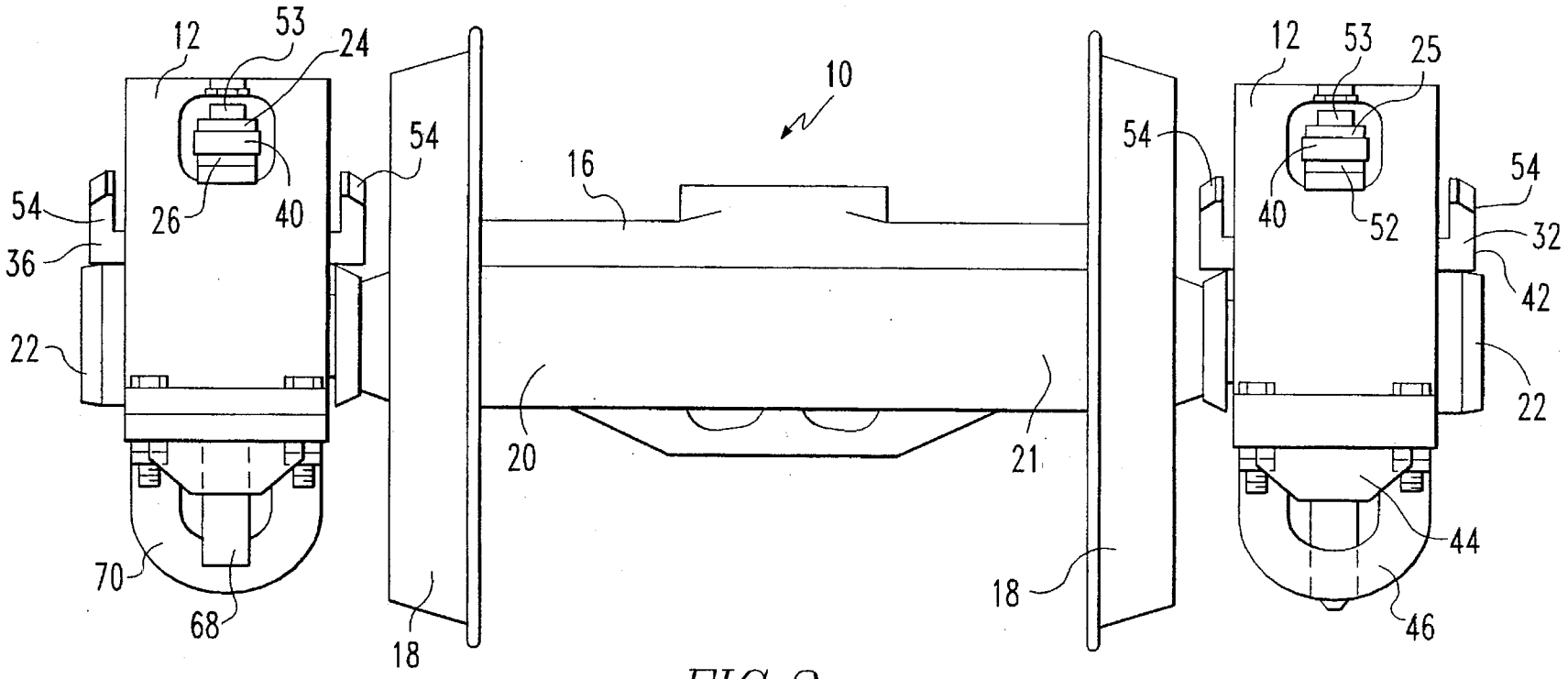
FIG. 2 is an end view taken on lines II—II of FIG. 1.
Figure 3:
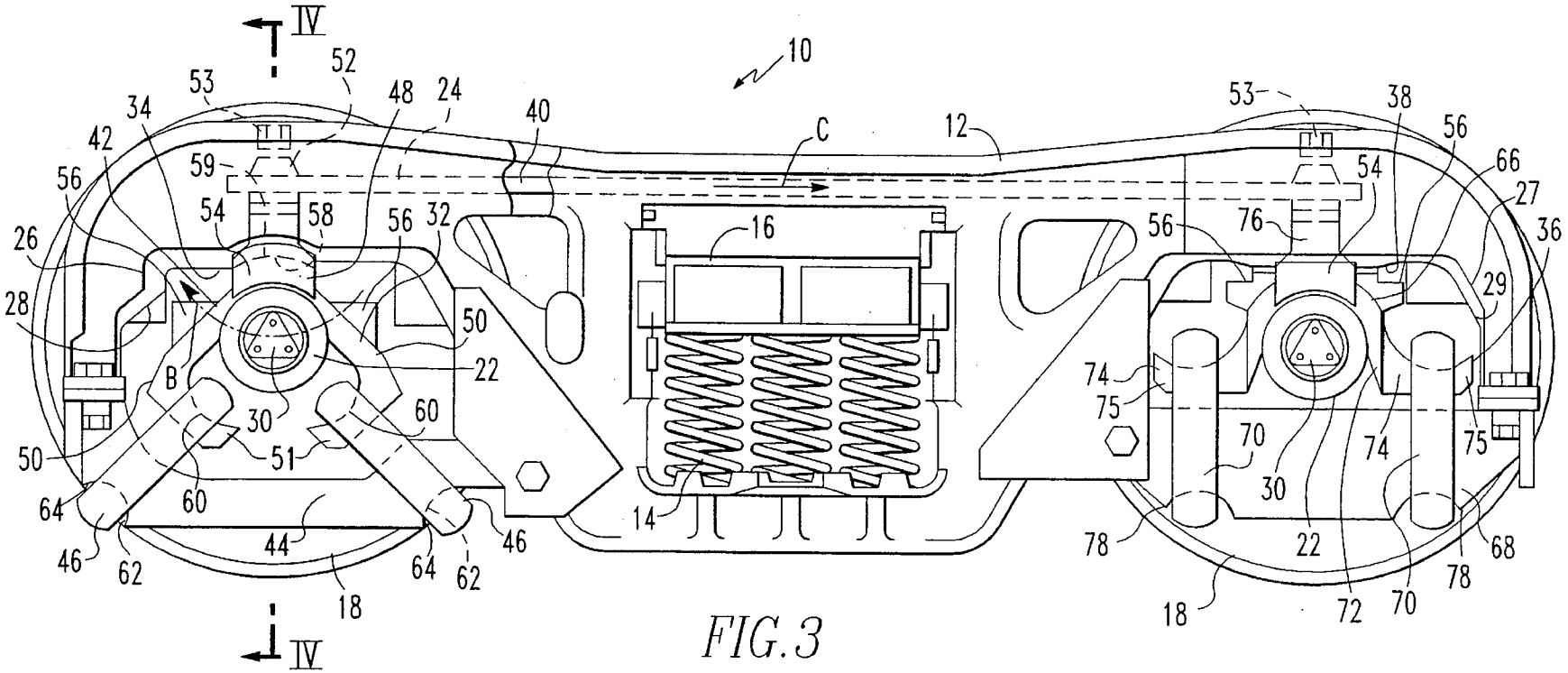
FIG. 3 is a side elevation taken on lines III—III of FIG. 1.
Figure 4:
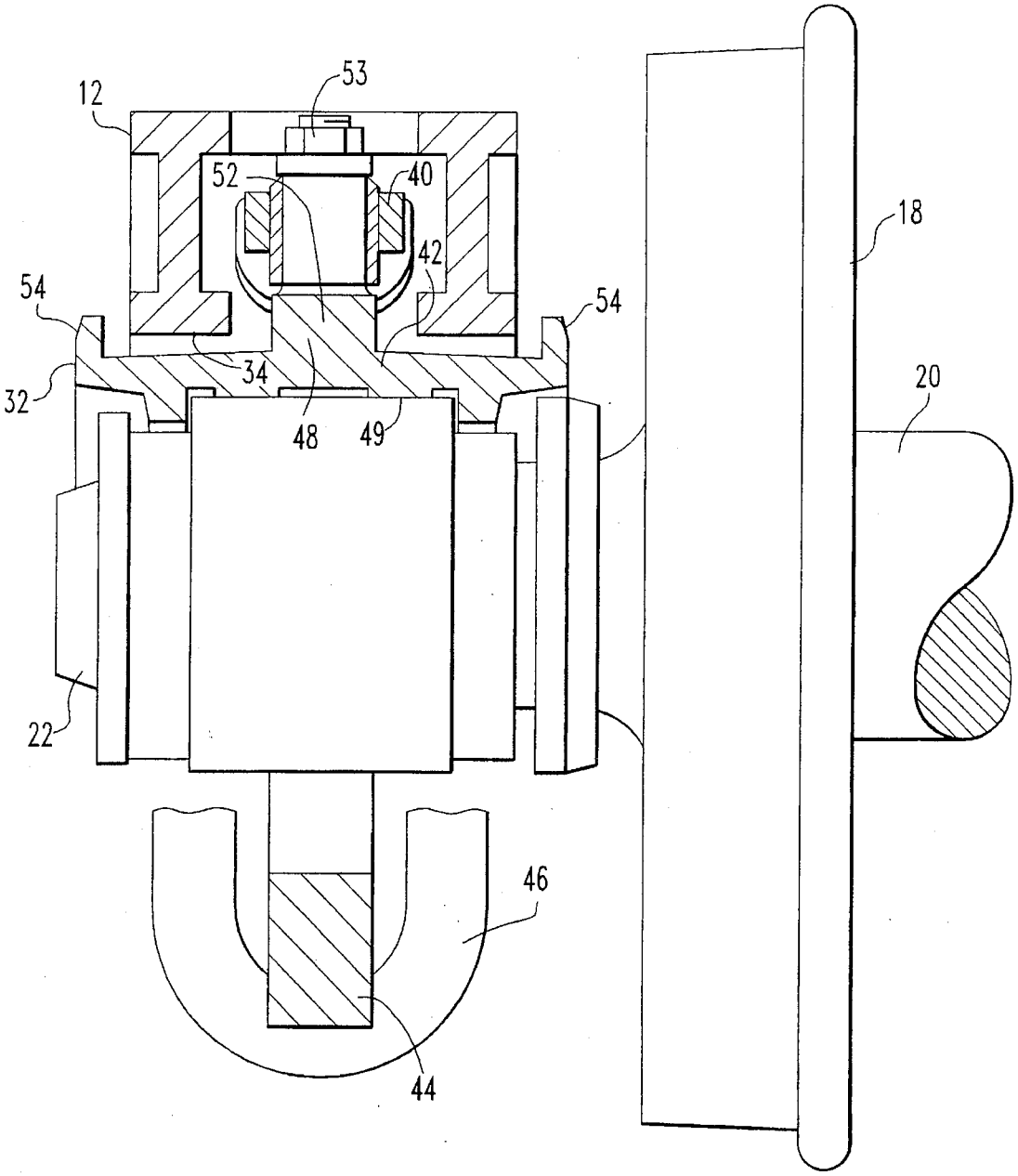
FIG. 4 is a sectional view taken on lines IV—IV of FIG. 3.

In FIGS. 1, 2 and 3 there is generally indicated at 10 a railway truck constructed in accordance with an illustrative embodiment of the instant invention. Truck 10 comprises a pair of spaced side frames 12 which carry respective, conventional spring groups 14 (FIG. 3) to support a conventional bolster 16. Coned wheels 18 are suitably affixed to axles 20 to provide conventional wheelsets 21. The wheelsets 21 include known, sealed roller bearing assemblies 22 which are pressed on respective ends 23 of axles 20 and are retained by axle end caps 30. The roller bearing assemblies 22 cooperate with respective steering apparatus 24 and 25 to support side frames 12 with respect to the axles 20 in a manner, as will be described hereinbelow in detail, to permit limited movement of the axle ends 23 longitudinally with respect to side frames 12. That is, each pair of axle ends 23 supporting a side frame 12 can move in the direction of the longitudinal extent of the side frame 12. The cooperation of the roller bearing assemblies 22 with steering apparatus 24 and 25 also provides the wheelsets 21 lateral freedom with respect to the side frames 12.

The structure supporting side frames 12 with respect to wheelsets 21 thus allows the wheels 18 to track radially when the truck 10 is traversing track curves. The invention herein is primarily directed to the steering apparatus 24 and 25 and the same in combination with novel side frames and known truck elements, some of which are set forth hereinabove. Since such truck elements are generally well known in the art, further detailed description thereof is believed unnecessary for a complete understanding of the present invention. Further description of such known truck elements is provided hereinbelow only insofar as is necessary to fully describe the invention.

For purposes of the following description, upper and lower shall refer, respectively, to the upper and lower portions of truck 10 as shown in FIGS. 2 and 3. Moreover, forward or leading end and rearward or trailing end shall refer, respectively, to the left and right ends of truck 10 as shown in FIGS. 1 and 3.

Referring to FIG. 3, each axial end portion of one side frame 12 includes a respective pedestal portion 26, 27, and each pedestal portion 26, 27 includes a respective downwardly open pedestal opening 28, 29. One of the roller bearing assemblies 22 is received in each pedestal opening 28, 29.

Steering apparatus 24 comprises a rotational steering assembly 32 disposed adjacent the pedestal opening 28 and including a portion which extends intermediate the pedestal opening roof 34 of pedestal opening 28 and the adjacent wheelset bearing assembly 22. The rotational steering assembly 32 supports the adjacent end of side frame 12 with respect to the corresponding wheelset bearing 22. Steering apparatus 24 also includes a translational steering assembly 36 disposed in the longitudinally opposed pedestal opening 29 of the same side frames 12. Steering assembly 36 includes a portion which extends intermediate the pedestal opening roof 38 of pedestal opening 29 and the adjacent wheelset bearing 22. Steering assembly 36 supports the adjacent end of side frame 12 with respect to the corresponding wheelset bearing 22.

A connecting link 40 extends longitudinally with respect to, and preferably within interior portions of side frame 12 and is secured adjacent its opposed axial ends to upwardly extending portions of the steering assemblies 32 and 36, respectively.

The steering apparatus 24 shown in FIG. 1 is disposed with respect to the corresponding side frame 12 such that its rotational steering assembly 32 is located adjacent the leading end of truck 10 and the translational steering assembly 36 is located adjacent the trailing end of the truck 10. Steering apparatus 25 of the other side frame 12 can be virtually identical to steering apparatus 24, and is preferably turned 180 degrees with respect thereto to assume an orientation opposite that of steering apparatus 24, that is, with its rotational steering assembly 32 located adjacent the trailing end of truck 10 and its translational steering assembly 36 located adjacent the leading end of truck 10. Since the opposed pedestal openings of the side frames 12 are of different configuration to accommodate the respective steering assemblies 32 and 36, the side frames 12 also are disposed in opposed longitudinal orientation consistent with the described locations of the respective steering assembly 32 and 36. From the above, it may be appreciated that the described steering apparatus is identical in structure and operation, irrespective of the direction of truck travel. Accordingly, it will be appreciated that references to leading and trailing ends of the truck are purely for illustrative purposes.

Referring to FIGS. 1–4, rotational steering assembly 32 includes a rigid bearing adapter 42 located intermediate pedestal roof 34 and the bearing assembly 22, and a retaining and supporting member 44 which extends longitudinally across the pedestal opening 28 adjacent a lower portion thereof. The opposed longitudinal end portions of member 44 are suitably formed to be secured adjacent respective longitudinally opposed portions of pedestal portion 26. A pair of longitudinally spaced steering link members 46 extend in downwardly diverging fashion between vertically spaced portions of bearing adapter 42 and member 44.

Bearing adapter 42 comprises a main body portion 48 and a pair of longitudinally spaced, downwardly and outwardly diverging link support portions 50, each having a generally inwardly projecting hook end portion 51 to receive links 46. A connection portion 52 extends upwardly of adapter body portion 48 into the interior of side frame 12 whereat the portion 52 is flexibly, releasably connected to the adjacent longitudinal end of connecting link 40 in any suitable manner, for example by means of a threaded stud and nut assembly 53 or the like.

Bearing adapter 42 additionally includes a pair of transversely spaced, upwardly extending lug or gib portions 54 which overlap and are engagable with adjacent portions of side frame 12 for limiting transverse movement of the steering assembly 32 with respect to the side frame 12. Bearing adapter 42 also includes a pair of opposed, longitudinally spaced lug portions 56 which are engagable with adjacent portions of side frame 12 within pedestal opening 28 for limiting longitudinal movement of the steering assembly 32 with respect to the side frame 12. The gibs 54 and lugs 56 thus retain bearing adapter 42 in its operative position with respect to side frame 12. The indicated clearances, which are not necessarily to scale as shown, between elements 54 and 56 and the respective adjacent surfaces of side frame 12 limit the maximum transverse and longitudinal movement of the adapter 42, and thus of the axle 20, with respect to side frame 12. For example, in typical operating conditions a longitudinal clearance between each of lug portions 56 and longitudinally adjacent portions of pedestal opening 28 in the range of ¼ in. to ⅜ in. may be satisfactory.

Bearing adapter body portion 48 also includes a support portion having a generally arcuate cross-sectional configuration such that at least a central portion of a downwardly facing surface 49 thereof (FIG. 4) conforms to the outer periphery of the adjacent roller bearing assembly 22, and at least a central portion of an upwardly facing surface 59 thereof conforms with an adjacent arcuate peripheral surface 58 of pedestal opening roof 34. Surfaces 58 and 59 are formed preferably as radiused or arcuate surfaces to permit bearing adaptor 42 to accommodate relative longitudinal freedom of the wheelset axle end with respect to side frames 12 by rotation of bearing adaptor 42 with respect to the side frame 12, as indicated by arrow B in FIG. 3.

Links 46 may be of any suitable construction, for example double-ended eye bars. The top eye opening 60 of each link 46 is suitably, captively received by the respective hook end 51 of one of the link support portions 50, the link eye portion and hook end 51 being mutually engaged on surfaces of geometry which provides rolling contact therebetween so that links 46 can freely swing, within predetermined limits, in both the longitudinal and transverse directions. Links 46 extend downwardly in diverging fashion from the respective adapter hook portions 51. In the assembled configuration, the lower eye opening 62 of each link 46 engages a respective, formed longitudinal end portion 64 of retaining and supporting member 44 in a manner to provide rolling contact therebetween. The link suspension of side frame 12 by links 46 thus accommodates longitudinal and transverse freedom of the axle 20 with respect to the side frame 12.

Translational steering assembly 36 is similar in many respects to rotational steering assembly 32 discussed hereinabove; however, one primary distinction therebetween is that while the bearing adapter 42 of steering assembly 32 is rotatable, within limits, about an axis extending parallel or coincident with the longitudinal axis of axle 20, the bearing adapter 66 of translational steering assembly 36 cooperates with other elements including side frame 12 in a manner that it is essentially non-rotatable with respect to the longitudinal axis of the corresponding wheelset axle 20, but rather is movable in longitudinal translation with respect to the side frame 12.

Translational steering assembly 36 comprises the rigid bearing adapter 66 located intermediate pedestal roof 38 and bearing assembly 22, and a retaining and supporting member 68 which extends longitudinally across the pedestal opening 29 of pedestal portion 27 adjacent a lower portion thereof. The opposed longitudinal end portions of member 68 are suitably formed to be secured adjacent respective longitudinally opposed portions of the pedestal portion 27. Also included is a pair of longitudinally spaced steering link members 70 which extend between adjacent vertically spaced portions of bearing adapter 66 and member 68.

Bearing adapter 66 comprises a maim body portion 72 and a pair of longitudinally spaced, formed, link support portions 74, each having a generally upwardly projecting hook end portion 75. A connection portion 76 extends upwardly from main body portion 72 into the interior of side frame 12 where it is flexibly connected to the adjacent longitudinal end of connecting link 40 by such suitable means as a threaded stud and nut assembly 53. The connection portions 52 and 76 of the rotational and translational steering assemblies, respectively, thus are connected at longitudinally spaced locations to link 40. Bearing adapter 66 additionally includes transverse and longitudinal motion limiting gib and lug portions 54 and 56, respectively, which, similarly to the corresponding gibs and lugs of steering assembly 32, cooperate with portions of side frame 12 surrounding pedestal opening 29 to retain the bearing adapter 66 in its operational position and to limit the maximum longitudinal and transverse movement thereof.

Specifically, gibs 54 are laterally spaced from the adjacent side frame surfaces to permit limited lateral transverse freedom of bearing adapter 66 and the corresponding wheelset 21 with respect to the respective side frame 12. Similarly, lugs 56 are longitudinally spaced from adjacent side frame surfaces to permit limited longitudinal freedom of the bearing adapter 66 and corresponding wheelset 21 with respect to the side frame 12. The same sort of lateral and longitudinal spacing or clearance provides the lateral and longitudinal freedom described above with reference to steering assembly 32.

The upper periphery of bearing adapter body portion 72 may be generally of horizontal planar form to conform with a generally planar extent of the pedestal opening roof surface 38 to permit the desired longitudinal translational freedom therebetween. The lower periphery of adapter body portion 72 is of arcuate form to conform with the adjacent outer periphery of roller bearing assembly 22.

The links 70 extend generally vertically between hook ends 75 and respective, longitudinally spaced, formed end portions 78 of retaining and supporting member 68 for rolling engagement therewith as above described in the description of steering assembly 32. Thus the engagement of links 70 with the cooperable bearing adapter and supporting member portions 74 and 78 provides rolling contact for free swinging support of side frame 12, within limits, to accommodate longitudinal and transverse freedom of axle 20 with respect to the side frame 12.

The steering assemblies 32 and 36 provide sufficient longitudinal freedom at the bearing journals that each wheelset 21 can assume an optimum radial position on track curves with the rotational axis of each axle 20 extending through the center point of the track curve, thereby permitting the trucks to steer around curves with a minimum of wheel sliding or flange-to-rail head contact. Thus, the wheels 18 will tend to roll through track curves rather than sliding. For a more detailed description of the manner of operation of a wheelset-side frame isolation type steering assembly, such as steering assembly 32 and 36, the reader is referred to U.S. Pat. No. 4,512,261, the entire disclosure of which is incorporated herein and made a part hereof by reference.

The steering assemblies 32 and 36 permit the truck wheelsets to steer by yawing symmetrically with respect to each other, the axles 20 being relatively free to move simultaneously within predetermined limits with respect to the side frames 12. Notwithstanding such wheelset freedom, the propensity toward hunting responses is controlled. More specifically, in conventional trucks independent wheelset yaw will result in cyclical truck warp or shear behavior which is conducive to hunting at lower speeds. The steering apparatus 24 and 25 provide articulation between the steering wheelsets in a manner that the axle ends on each side of the truck undergo equal and opposite movements longitudinally with respect to the side frames as described hereinbelow. Symmetry of movement is thus maintained between the pair of axle ends at each side of the truck.

Referring to FIGS. 1 and 3, if the wheel 18 adjacent rotational steering assembly 32 of steering apparatus 24 is viewed as the leading wheel and the truck 10 is traversing a curve as indicated by arrow A (FIG. 1), the following sequence of steering articulation and axle movements will occur as the truck 10 traverses the curve.

First, the wheel conics will cause the leading wheelset 21 to seek a radial position on the curved track and in so doing the axle end toward the outside of the curve will tend to move forward from the neutral position shown in FIG. 3. In response, the bearing adapter 42 of the rotational steering assembly 32 will tend to rotate in a clockwise direction as indicated by arrow B. The geometry of bearing adapter 42 and the cooperating elements including links 46 as above described is such that the bearing adapter rotation proceeds preferably about a center located vertically between the central axis of the wheelset axle 20 and the connection of bearing adapter portion 52 to link 40. Thus, on rotation of bearing adapter 42 as depicted by arrow B the axle end portion adjacent the steering assembly 32 moves forwardly with respect to the longitudinal extent of side frame 12. This moves link 40 rearwardly, as indicated by arrow C in FIG. 3, with respect to side frame 12.

As a result of this movement of link 40, bearing adapter 66 of steering assembly 36 on the same side frame is urged to translate rearwardly by the connection thereof with link 40, and hence the adjacent end of the respective axle 20 is also urged longitudinally rearwardly and away from the longitudinal axis of bolster 16. Thus, the steering assembly 24 will cause the corresponding ends of axles 20 to move symmetrically with respect to the longitudinal axis of bolster 16 away from each other, and the corresponding wheels 18 which are on the outer side of the track curve thus can move toward radial alignment with the track curve. Both of the wheels 18 on the outer side of the track curve will tend to align radially with the curve of the rail supporting them and the impetus to produce the movement to a radially aligned position is mutual, with each wheel 18 being urged to move through action of the described steering apparatus to a radially aligned position by movements of the other wheel.

Similarly, on the other side of the truck (i.e., on the inner side of the track curve) the wheels 18 will tend to slide on the inner rail if not radially aligned with the rail. Achieving radial wheelset alignment on the inner side of the track curve requires the corresponding axle ends to move relatively toward one another, which is the opposite of the relative axle movement described above for the radially outer side of the truck. The steering apparatus 24 and 25, however, operate to provide for symmetrical longitudinal movement of the axle ends with respect to the side frames on either side of the truck whether the axle ends are tending to move toward each other or away from each other. The longitudinal movement of the axle ends thus is symmetrical with respect to the longitudinal axis or extent of the bolster 16 at both lateral sides of the truck. Accordingly, the steering impetus of steering apparatus 25 on the inner side of the track curve, operating in the same manner as above described for steering apparatus 24, will urge the corresponding ends of the axles 20 toward the longitudinal axis of bolster 16 in symmetrical, longitudinally opposed movements. The wheels 18 on the inner side of the track curve thus move toward radial alignment with the curvature of the inner rail in much the same manner that the wheels 18 on the radially outer side of the truck achieve radial alignment with the track curve.

Thus, it is to be noted that the bearing adapter 42 of the rotational steering assembly 32 of steering apparatus 25 on the inner side of the track curve will rotate in a direction to urge the adjacent end of axle 20 toward the bolster centerline. In turn, this rotary movement results in movement of the interconnection between the bearing adapter 42 and connecting link 40 away from the bolster centerline. The corresponding bearing adapter 66 at the opposed end of the track is thus urged by link 40 toward the bolster centerline.

As may be appreciated, the described steering apparatus effectively constrains the axle ends at each lateral side of the truck to move longitudinally with respect to each other in unison and symmetrically with respect to the corresponding side frame to achieve a radial configuration on curved track. The described steering apparatus constrains all tendency of the wheelsets to change lateral alignment with respect to the track, and thus is also effective to constrain wheelset excursions from a square configuration with respect to the rails on straight track.

In addition to the operating features of the invention described hereinabove, other benefits of the invention are to be noted. For example, the steering structure coupling the wheelsets is simple, effective and generally insensitive to tolerance and alignment variations. Moreover, because the connecting links 40 extend within interior spaces of the side frames 12, anticipated service life is longer and maintenance requirements reduced for the connecting links 40 since the links are isolated from the harsh operating environment of the truck.

An additional benefit of the invention is that the link members 46 and 70 provide a gravitational centering bias which acts on the wheelset axle to facilitate squaring of the truck 10. The divergence of link members 46 also permits a sufficient moment to be developed for rotation of the bearing adapter 42 of the rotational steering assembly 32 in response to the tracking tendencies of the wheel conics as described above. Since one set of diverging links 46 is active on each wheelset and, further since the wheelsets act in tandem due to action of the connecting links 40, the gravitational self-centering effect of links 46 is also transmitted to the translational steering assembly 36. As noted, links 70 of steering assembly 36 provide a similar gravitational self-centering effect. When links 70 move from the illustrated vertical orientation in response to steering impulses, their slightly angled orientation with respect to vertical results in a slight lifting of the side frame with respect to the corresponding bearing adapter. The gravitational tendency of the side frame to seek the lowest possible elevation with respect to the bearing adapter will continuously urge links 70 toward their vertical orientation, which is their orientation when the corresponding axle end is positioned in a square configuration with respect to the truck 10.

It is noted further that excursions of the wheelsets from a square configuration also will rotate the bearing adapters in the horizontal plane thereby moving the links 46 and 70 laterally from their neutral orientation. This also imparts a gravitational tendency toward a return to a mutually centered and square wheelset configuration. Finally, lateral translation of the wheelsets with respect to the side frames will result in similar movements of links 46 and 70 from their neutral position thus once again creating a gravitational self-centering effect tending to oppose such lateral wheelset translation by returning the wheels to a mutually laterally aligned configuration.

The diverging link members 46 of the rotational steering assembly 32 provide a geometry which induces the desired rotational movement of the respective bearing adapter whereas the vertical links 70 of the translational steering assembly 36 provide a geometry which permits the respective bearing adapter to effectively translate longitudinally of the side frame without rotation. The geometry of the steering assemblies 32 and 36 thus cooperates, through the mutual connections with link 40, to produce the desired steering action, as well as other constraints on longitudinal and lateral wheelset excursions, as described.

The above-described embodiment is preferably constructed in a manner that the rotational and translational steering assemblies 32 and 36, respectively, are positioned in an opposite-hand arrangement on opposite sides of the truck 10, with each axle 20 having one steering assembly 32 and one steering assembly 36. Such an arrangement permits a pair of side frames 12 merely to be turned 180 degrees with respect to each other to accommodate the described steering apparatus to both sides of the truck. However, if one were disposed to make left and right hand side frame castings, a steering truck according to the above description could be constructed with the steering apparatus 24 and 25 identically positioned, each comprising a steering assembly 32 at the same end of the truck and the connecting links 40 extending longitudinally to a steering assembly 36 located at the opposite end of the truck. The invention thus does not require the opposite-hand arrangement of steering apparatus described hereinabove.

Figure 5:
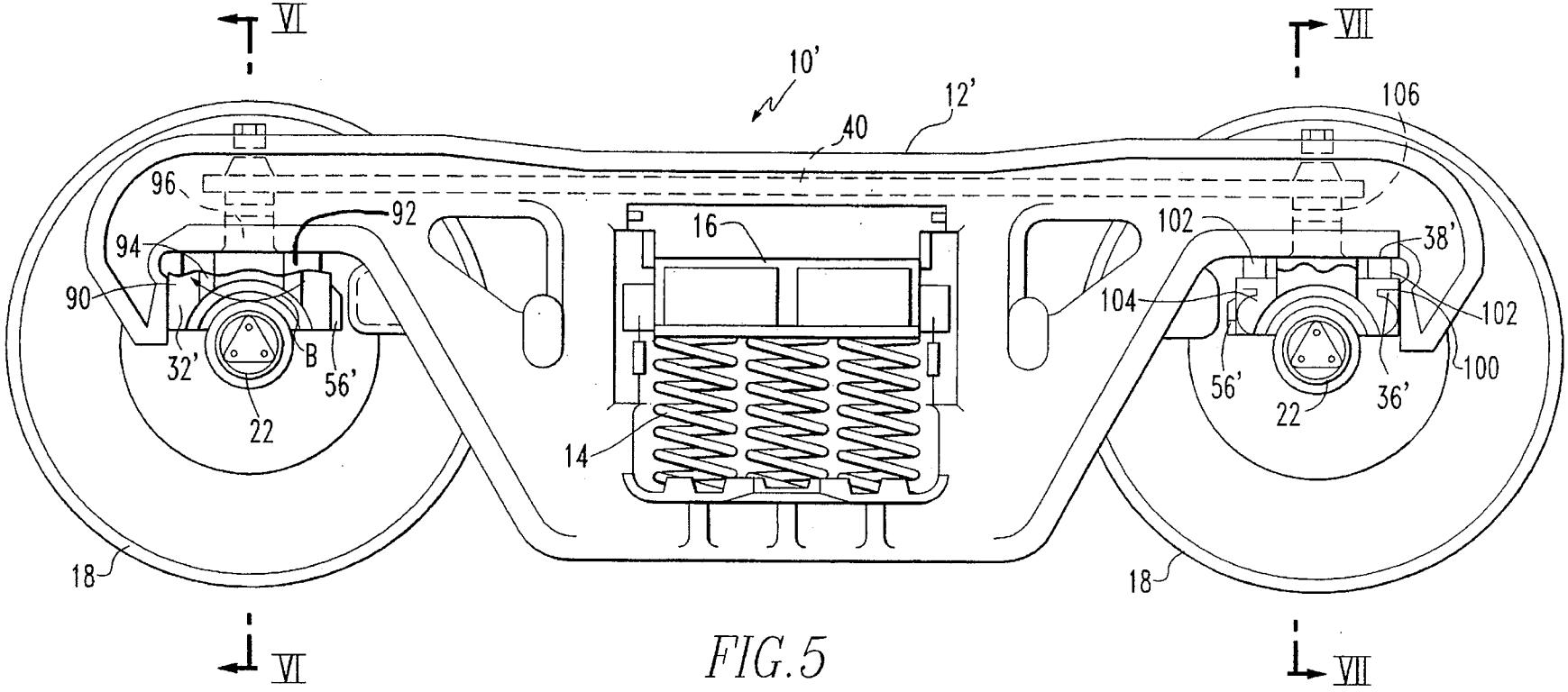
FIG. 5 is a side elevation of a three-piece railway truck showing a preferred embodiment of the present invention.
Figure 6:
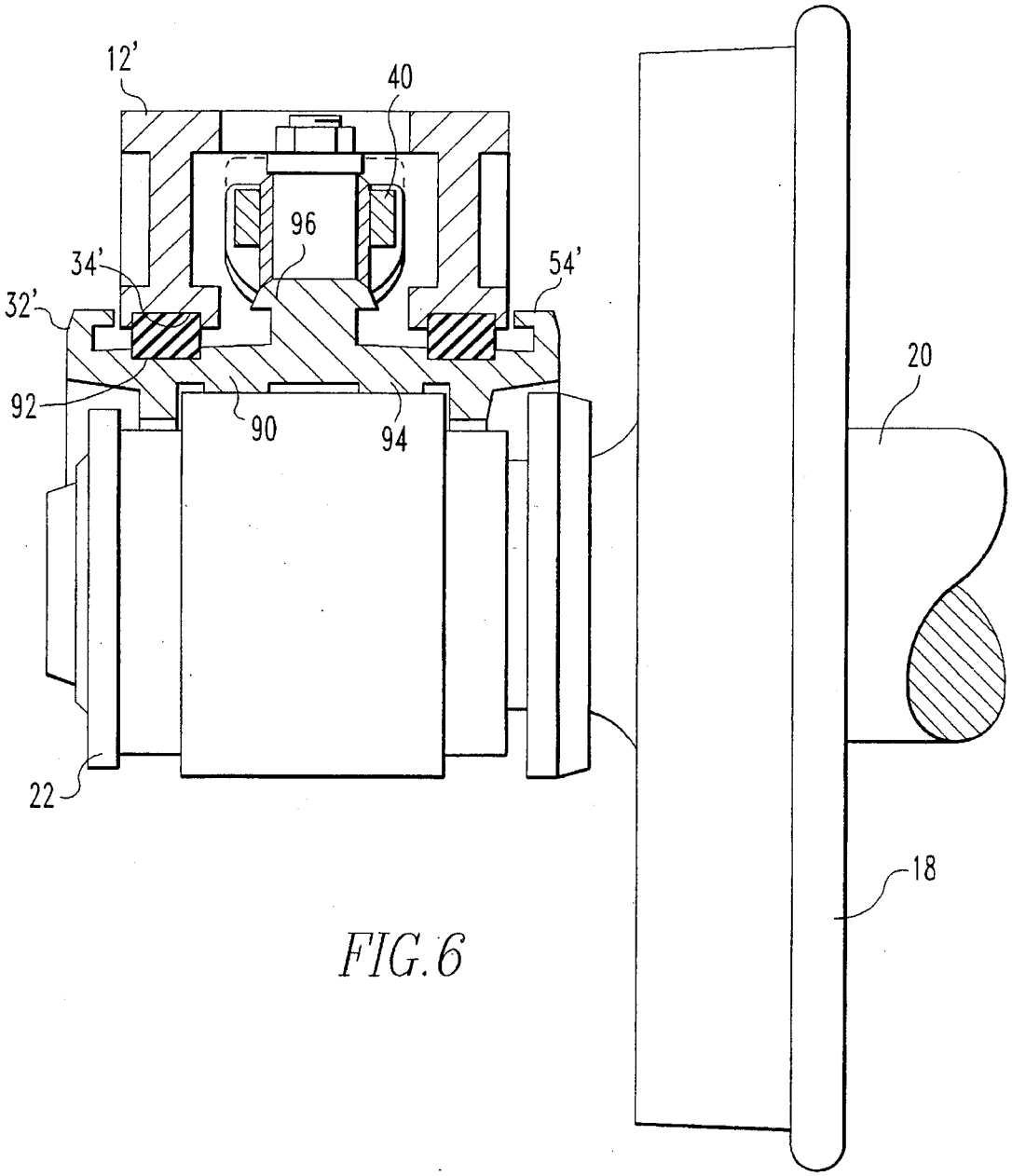
FIG. 6 is a sectional view taken on lines VI—VI of FIG. 5.
Figure 7:
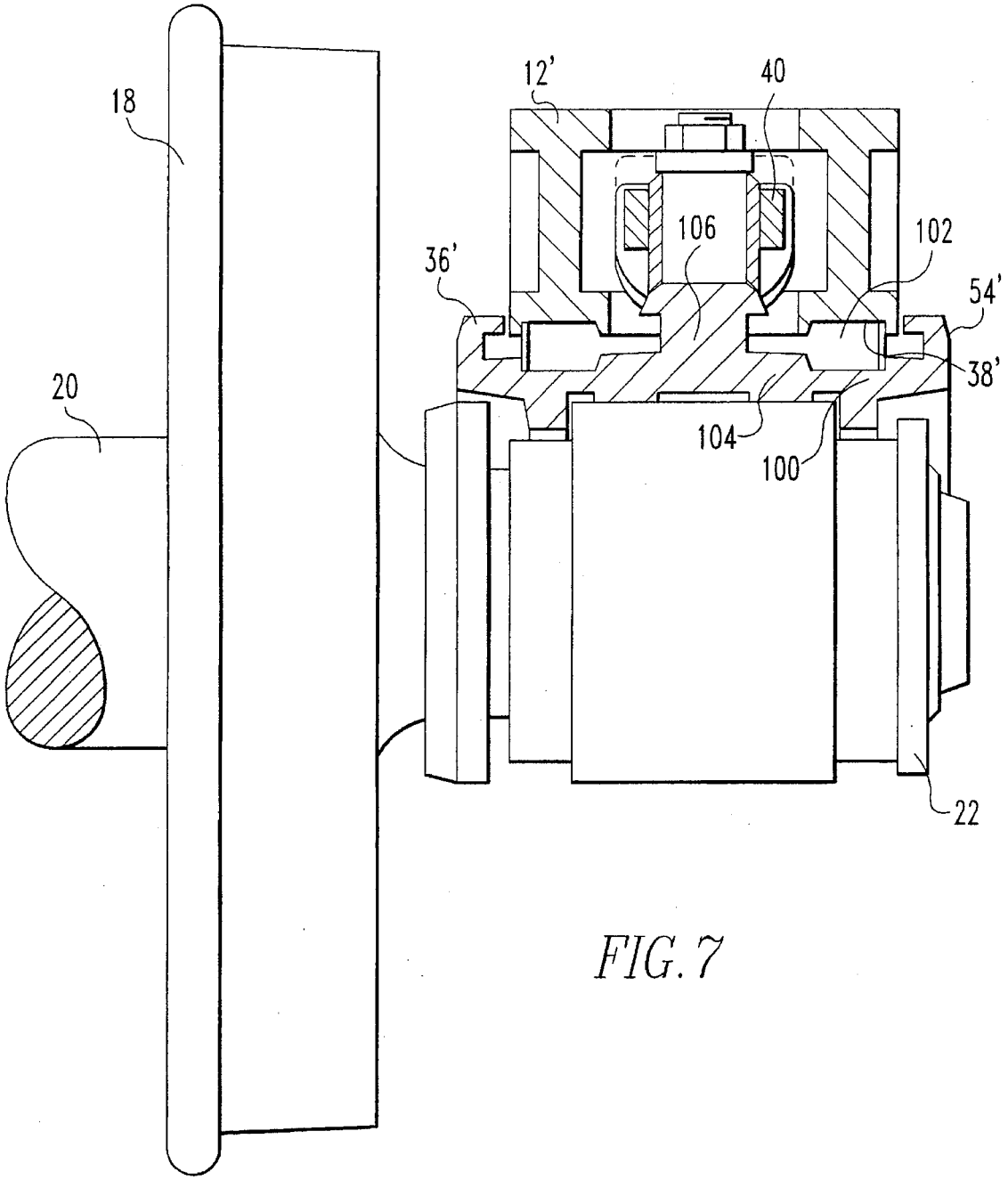
FIG. 7 is a sectional view taken on lines VII—VII of FIG. 5.

FIGS. 5 through 7 illustrate a presently preferred embodiment of the invention in a railway truck 10' which is similar in many salient respects to the truck 10 described hereinabove. The primary distinction between trucks 10 and 10' resides in the steering assemblies of truck 10' utilizing elastomeric elements in lieu of mechanical suspension links to provide the requisite controlled isolation of the wheelsets from the side frames. Because the trucks 10 and 10' are similar, elements of the embodiment of FIGS. 5 through 7 which are the same as those of the embodiment of FIGS. 1 through 4 will be identified with identical reference numerals, and elements which are similar, as in being functionally similar for example, will be identified with identical reference numerals primed. Furthermore, a detailed description of the operation of such identical and similar elements of the FIGS. 5 through 7 embodiment would be repetitious and therefore will not be set forth hereinbelow except insofar as is necessary to fully describe the preferred embodiment of the invention.

Referring now to FIGS. 5 through 7, truck 10' includes a steering apparatus 24' and a virtually identical steering apparatus (not shown) at the opposed lateral side of the truck. These steering apparatus provide the functions of steering apparatus 24 and 25 described hereinabove; however, in truck 10' the steering assemblies 32' and 36' utilize formed elastomeric elements to provide the above-described limited longitudinal and transverse freedom of the wheelsets as described with reference to FIGS. 1 through 4.

The rotational steering assembly 32' of steering apparatus 24' comprises a bearing adapter 90 positioned intermediate the pedestal roof and the bearing assembly 22. An elastomeric bearing element 92 is disposed intermediate the pedestal roof and the bearing adapter 90. The bearing adapter 90 includes a main body portion 94 and a connection portion 96 which extends upwardly from body portion 94 and into the interior of side frame 12' where it is suitably, releasably connected to an adjacent axial end of connecting link 40. The bearing adapter 90 additionally includes transverse gib portions 54' and longitudinal lug portions 56' which, in a manner similar to like elements steering assembly 32, act to retain the bearing adapter 90 in its operational position and to limit longitudinal and transverse movement thereof.

Bearing adapter body portion 94 may have a cross-sectional configuration with a lower arcuate periphery which conforms to the periphery of the adjacent roller bearing assembly 22 for engagement therewith, and an upper periphery which conforms to an adjacent mating peripheral portion of elastomeric element 92. For example, the engagement between the pedestal roof, bearing adapter body 94, and elastomeric element 92 may be similar to that of the corresponding portions of elastomeric elements disclosed in U.S. Pat. No. 5,009,521 to accommodate the described rotational freedom of bearing adapter 90 and the corresponding wheelset axle end movements. The entire disclosure of the cited U.S. Pat. No. 5,009,521 is hereby incorporated in this description and made a part hereof by reference.

Longitudinal forces including steering forces evolved by wheel-to-rail contact and forces applied by connecting link 40 to bearing adapter 90 cause rotation of adapter 90 about a point above the centerline of axle 20, for example as indicated by arrow B in FIG. 5. This results in differential compression of elastomeric element 92. Elastomeric element 92 is also designed to deform in horizontal shear to provide limited lateral freedom for bearing adapter 90 and axles 20 with respect to side frames 12. Adapter gibs 54' are spaced laterally from the adjacent vertical surfaces of side frames 12 to provide relative lateral motion limits.

The translational steering assembly 36' is similar to steering assembly 32'; however, as noted the bearing adapter 90 of steering assembly 32' is rotatable with respect to the side frame 12'. By contrast, bearing adapter 100 of steering assembly 36' is configured and restrained with respect to side frame 12' to be movable in longitudinal translation, but essentially non-movable in rotation with respect to the side frame 12'.

Steering assembly 36' comprises the bearing adapter 100 and a pair of longitudinally spaced elastomeric bearing elements 102 disposed intermediate the pedestal roof 38' and the bearing adapter 100. Adapter 100 includes a body portion 104, a connecting portion 106, gib portions 54' and lug portions 56', similar in most salient respects and performing similar functions to those described with reference to the corresponding elements of steering assembly 32'. Further, elastomeric elements 102, like the above described elastomeric element 92, may engage the bearing adapter and the pedestal roof in a manner similar to corresponding portions of the elastomeric elements disclosed in the above cited U.S. Pat. No. 5,009,521.

The upper periphery of adapter body portion 104 may be generally planar to conform with corresponding surfaces of elastomeric elements 102. The mating relationship between adapter 100 and elastomeric elements 102 results in bearing adapter 100 being movable essentially only in longitudinal and transverse translation with respect to the side frame 12' by elastomeric shearing deformation of elastomeric elements 102, but not in rotation as is adapter 90. To achieve this, elastomeric elements 102 must be separated by a sufficient longitudinal distance that the longitudinal force of the steering links 40 results in only insignificant relative rotation of bearing adapter 100, compared to the rotation of adapter 90. Thus, although insignificant rotation of bearing adapter 100 may occur, depending upon the thickness and stiffness or compressibility of the elastomeric elements 102, such rotation is insufficient to influence operation of the steering assembly 36' while the comparatively larger rotation of adapter 90 is sufficient to influence operation of steering assembly 32' as described.

The steering assemblies 32' and 36' operate essentially in the same manner as the above described steering assemblies 32 and 36, respectively, except that the bearing adapter movements which occur under the control of mechanical swing link movement in steering assemblies 32 and 36 occur under the control of elastomeric element deformation in steering assemblies 32' and 36'. Thus, in a similar fashion to steering assemblies 32 and 36, the steering assemblies 32' and 36' allow the wheelsets of a truck to steer. As in the other described embodiments, the wheelsets are coupled at each side of the truck by connecting links 40 so that the steering action is characterized by equal and opposite wheelset yaw movements to maintain symmetry of the wheelsets with respect to the bolster.

The sequence of steering responses or actions for steering apparatus 24' and 25' will be quite similar to those of apparatus 24 and 25 as described hereinabove; however, as noted, with steering apparatus 24' and 25' the limited longitudinal and transverse motion capability, both rotational and translational, as well as isolation of the wheelsets with respect to the side frames 12', is provided by the elastomeric elements 92 and 102 rather than by link arrangements. More specifically, the elastomeric elements 92 and 102 will deform initially in the direction of the force applied thereto, thereby providing a degree of controlled translational and rotational freedom for the respective bearing adapters as described. Furthermore, if the applied force is great enough, the elastomeric element 102 may break friction and slide on the respective pedestal roof portion 38', thereby allowing additional controlled movement, within prescribed limits, of the wheelset with respect to the side frames 12'. The elastomeric elements 92 and 102 may be of any suitable elastomer which will withstand the particular characteristics of the operating environment. For example, they must be capable of operation under the large compression loads of a loaded railway car as well as in unloaded car conditions. They also must be able to withstand the full range of operating temperatures encountered as well as all other operating conditions.

It will be appreciated that the embodiments described hereinabove are merely exemplary, Various alternative and modified embodiments may be made without departing from the spirit of the invention. For example, the invention is equally applicable to truck designs other than three-piece freight trucks such as transit trucks wherein the side frames may be inboard of the wheel and which may or may not have conventional truck bolsters to support the car body. Additionally, other functionally equivalent arrangements may be utilized for isolating the wheelsets from the side frames in lieu of the swing link arrangements and elastomeric elements described hereinabove.

These and other embodiments and modifications having been envisioned and anticipated, it is intended that the invention should be construed broadly and limited only by the scope of the claims appended hereto.

I claim:

1. In a railway truck having a pair of spaced apart wheelsets and frame means extending between the wheelsets and supported with respect to a respective pair of axle portions of the wheelsets, an apparatus for controlling steering movements of the wheelsets with respect to the frame means comprising:

a restraining means interconnecting such wheelsets and cooperable therewith and with such frame means to constrain movements of such wheelsets with respect to such frame means;

said restraining means including a pair of longitudinally spaced steering assemblies having a respective pair of rigid adapter means which are engagable with such pair of axle portions, respectively;

said steering assemblies further including a pair of articulation means which are cooperable with said pair of adapter means, respectively, and with such frame means to constrain movement of said pair of adapter means with respect to such frame means;

one of said articulation means being cooperable with the respective one of said pair of adapter means to constrain movement of said one of said adapter means with respect to such frame means such that the axle portion engaged by said one of said adapter means is movable longitudinally with respect to such frame means essentially in orbiting movement about a center displaced from the longitudinal axis of such axle portion;

the other of said articulation means being cooperable with the respective other of said pair of adapter means to constrain movement of said other of said adapter means with respect to such frame means such that the axle portion engaged by said other of said adapter means is movable longitudinally with respect to such frame means essentially in linear movement longitudinally of such frame means; and link means engaging said pair of adapter means and cooperable with said steering assemblies, respectively, to urge said pair of axle portions to move longitudinally with respect to such frame means in mutually opposed longitudinal directions.

2. The apparatus as set forth in claim 1 wherein said articulation means includes respective elastomeric means engaging said pair of adapter means and such frame means to support such frame means with respect to said pair of adapter means, respectively.

3. The apparatus as set forth in claim 2 wherein said one of said articulation means is operable by resilient deformation of the respective said elastomeric means including differential compressive deformation thereof.

4. The apparatus as set forth in claim 3 wherein said other of said articulation means is operable by resilient deformation of the respective said elastomeric means including longitudinal shearing deformation thereof.

5. A railway truck comprising:

a pair of spaced apart wheelsets;

a pair of laterally spaced apart frame means extending between said wheelsets;

steering apparatus for controlling steering movements of said wheelsets with respect to said frame means;

said steering means including restraining means interconnecting said wheelsets and cooperable therewith and with at least one of said frame means to constrain movement of said wheelsets with respect to said at least one of said frame means;

said restraining means including a pair of longitudinally spaced steering assemblies having a respective pair of adapter means which are engagable with said wheelsets, respectively;

said steering assemblies further including a pair of articulation means which are cooperable with said pair of adapter means, respectively, and with said at least one of said frame means to constrain movement of said pair of adapter means with respect to said at least one of said frame means;

one of said articulation means being cooperable with the respective one of said pair of adapter means to constrain movement of said one of said adapter means with respect to said at least one of said frame means such that the portion of the wheelset engaged by said one of said adapter means is movable longitudinally with respect to said at least one of said frame means essentially in orbiting movement about a center spaced upwardly from the longitudinal axis of said one wheelset;

the other of said articulation means being cooperable with the respective other of said pair of adapter means to constrain movement of said other of said adapter means with respect to said at least one of said frame means such that the portion of the wheelset engaged by said other of said adapter means is movable longitudinally with respect to said at least one of said frame means essentially in linear movement longitudinally of said at least one of said frame means; and link means engaging said pair of adapter means and cooperable with said steering assemblies, respectively, to constrain said wheelsets such that the portions thereof engaged by said adapter means, respectively, are urged to move simultaneously with respect to said at least one of said frame means in mutually opposed longitudinal directions.

6. The apparatus as set forth in claim 5 wherein said articulation means includes respective elastomeric means engaging said pair of adapter means and said at least one of said frame means to support said frame means with respect to said pair of adapter means, respectively.

7. The apparatus as set forth in claim 6 wherein said one of said articulation means is operable by resilient deformation of the respective said elastomeric means including differential compressive deformation thereof.

8. The apparatus as set forth in claim 7 wherein said other of said articulation means is operable by resilient deformation of the respective said elastomeric means including longitudinal shearing deformation thereof.

9. A method of controlling wheelset yaw movements of a pair of spaced wheelsets of a railway truck having a pair of elongated frame means each extending between said wheelsets and supported with respect to such spaced wheelsets by a respective pair of wheelset axle portions comprising the steps of:

interconnecting said pair of wheelset axle portions in a manner to transmit relative longitudinal movements of either one of said wheelset axle portions with respect to the respective said frame means directly to the other of said wheelset axle portions;

articulating said wheelsets independently of each other with respect to each of said frame means in a manner to constrain movements of said wheelset axle portions with respect to each of said frame means, respectively, in yaw and longitudinal translation, to movements of essentially equal magnitude and opposite directions with respect to said frame means, respectively; and said articulating of said wheelsets including constraining longitudinal movement of one of said wheelset axle portions with respect to the respective one of said frame means by limiting the longitudinal movement of said one of said axle portions to the longitudinal component of an orbital path of movement about a center of orbiting spaced above the rolling axis of the respective said wheelset.

10. The method as set forth in claim 9 wherein said articulating of said wheelsets further includes constraining longitudinal movement of the other of said wheelset axle portions with respect to said one of said frame means to the longitudinal component of a translational path of movement with respect to the longitudinal extent of said one of said frame means.

* * * * *